US006135737A

United States Patent [19]

Miura et al.

[11] Patent Number: 6,135,737

[45] Date of Patent: Oct. 24, 2000

[54] SCROLL HYDRAULIC MACHINE

[75] Inventors: Shigeki Miura; Kimiharu Takeda; Kazuhide Watanabe; Takeshi Hirano, all of Nishi-kasugai-gun, Japan

[73] Assignee: Mitsubishi Heavy Industries, Ltd., Tokyo, Japan

[21] Appl. No.: 09/103,562

[22] Filed: Jun. 24, 1998

[30] Foreign Application Priority Data

Jul. 10, 1997 [JP] Japan ..... 9-199160

[51] Int. Cl.[7] ..... F04C 18/00

[52] U.S. Cl. ..... 418/55.3; 418/178; 418/1; 464/102; 64/31

[58] Field of Search ..... 418/55.3, 178, 418/1; 464/102; 64/31

[56] References Cited

U.S. PATENT DOCUMENTS

| | | | |
|---|---|---|---|
| 4,121,438 | 10/1978 | McCullough | 64/31 |
| 4,655,696 | 4/1987 | Utter | 464/102 |
| 5,035,589 | 7/1991 | Fraser et al. | 418/1 |
| 5,275,543 | 1/1994 | Tanaka et al. | 418/55.3 |

FOREIGN PATENT DOCUMENTS

| | | |
|---|---|---|
| 0 475 545 | 3/1992 | European Pat. Off. . |
| 31 40 512 | 4/1983 | Germany . |
| 355002747A | 1/1980 | Japan . |
| 356075592A | 6/1981 | Japan . |
| 356083616A | 7/1981 | Japan . |
| 360075791A | 4/1985 | Japan . |
| 61-099555 | 5/1986 | Japan . |
| 403246388A | 2/1990 | Japan . |
| 405044401A | 2/1993 | Japan . |
| 408093664A | 4/1996 | Japan . |
| 2 259 967 | 3/1993 | United Kingdom . |

OTHER PUBLICATIONS

Patent Abstracts of Japan, vol. 013, No. 183 (M–820), Apr. 28, 1989, JP 01 012003, Jan. 17, 1989.

Patent Abstracts of Japan, vol. 012, No. 384 (M–753), Oct. 13, 1988, JP 63 134882, Jun. 7, 1988.

Patent Abstracts of Japan, vol. 016, No. 122 (M–1226), Mar. 27, 1992, JP 03 288015, Dec. 18, 1991.

Patent Abstracts of Japan, vol. 016, No. 232 (M–1256), May 28, 1992, JP 04 047184, Feb. 17, 1992.

Patent Abstracts of Japan, vol. 017, No. 544 (M–1489), Sep. 30, 1993, JP 05 149265, Jun. 15, 1993.

Patent Abstracts of Japan, vol. 096, No. 010, Oct. 31, 1996, JP 08 144980, Jun. 4, 1996.

Patent Abstracts of Japan, vol. 018, No. 341 (M–1629), Jun. 28, 1994, JP 06 081780, Mar. 22, 1994.

*Primary Examiner*—Thomas Denion
*Assistant Examiner*—Thai-Ba Trieu
*Attorney, Agent, or Firm*—Oblon, Spivak, McClelland, Maier & Neustadt, P.C.

[57] ABSTRACT

A scroll hydraulic machine comprising a housing having a key groove, a fixed scroll disposed in said housing, a swirling scroll having a key groove disposed in said housing, engaging with said fixed scroll, and moving in a swirling motion, and an Oldham ring provided with a swirling key engaging, in a freely sliding manner, with said key groove formed on said swirling scroll, and a fixed key engaging, in a freely sliding manner, with the key groove formed on said housing, and Sn plated on at least one side surface of the swirling key and the fixed key.

7 Claims, 7 Drawing Sheets

6;HOUSING
14;SWIRLING SCROLL
15;END PLATE
26;OLDHAM RING
26a;SWIRLING KEY
26b;FIXED KEY
26c;RING
36;THRUST BEARING
41,42,43;KEY GROOVE

SCROLL HYDRAULIC MACHINE

BACKGROUND OF THE INVENTION

1. Field of the Invention

The present invention relates to a scroll hydraulic machine used as a compressor or an expansion device. The present application is based on Japanese Patent Application No. Hei 9-199160, the contents of which are incorporated herein by reference.

2. Description of Related Art

A vertical cross-section of a conventional scroll compressor is shown in FIG. 8. In FIG. 8, reference numeral 1 denotes a housing comprising a cup-shaped body 2 and a front housing 6 attached to the cup-shaped body 2 by a bolt (not shown). A fixed scroll 10 meshing with a swirling scroll 14 are disposed within the housing 1. The swirling scroll 14 performs a rotational swirling motion, and this rotational swirling motion is controlled by an Oldham ring 26.

In FIG. 9, the Oldham ring 26 comprises a ring 26*c*, a pair of swirling keys 26*a*, and a pair of fixed keys 26*b*. Each swirling key 26*a* engages so as to freely slide in the direction of arrow A in a pair of a key groove 41 bored into the outer surface of the end plate 15 of the swirling scroll 14. Each fixed key 26*b* engages so as to freely slide in the direction of arrow B in a key groove 42 formed along the thrust bearing 36 and a key groove 43 bored into the inner end surface of the front housing 6.

In a conventional scroll compressor, the front housing 6 and the swirling scroll 14 are made of an aluminum alloy, and the Oldham ring 26 is made of a ferrous alloy. Because the ability of the aluminum alloy and the ferrous alloy to slide over one another deteriorates, there arises the problem that abrasion or seizure occur between the swirling key 26*a* and the fixed key 26*b* of the Oldham ring 26, and their a key groove 41 and 43, damaging the Oldham ring 26.

In addition, the sliding surfaces of the swirling key 26*a* and the fixed key 26*b* of the Oldham ring 26 and their key grooves 41 and 43 are lubricated by an aerosol oil incorporated in the gas drawn into the suction chamber 28. However, when the compressor is stopped for long periods of time, the liquid refrigerant clinging to the inside of the housing wash out the oil on the sliding surfaces, and due to this, when the compressor is restarted, abrasion or seizure occur on the sliding surfaces.

SUMMARY OF THE INVENTION

Accordingly, the object of the present invention is to provide a scroll hydraulic machine which is structured so as to prevent an Oldham ring from being broken by abrasion or seizure.

In order to solve this problem, the scroll hydraulic machine according to the first present invention is formed from a housing having a key groove, a fixed scroll disposed in said housing,a swirling scroll having a key groove disposed in said housing, engaging with said fixed scroll, and moving in a swirling motion, and an Oldham ring provided with a swirling key engaging, in a freely sliding manner, with said key groove formed on said swirling scroll, and a fixed key engaging, in a freely sliding manner, with the key groove formed on said housing, and Sn plated on at least one side surface of the swirling key and the fixed key.

According to this first invention, because the ability of the Sn-plating and the aluminum to slide over one another is superior, abrasion and seizure can be reduced.

In addition, in order to solve the above problem, the scroll hydraulic machine according to the second present invention is formed from a housing having a key groove, a fixed scroll disposed in said housing, a swirling scroll having a key groove disposed in said housing, engaging with said fixed scroll, and moving in a swirling motion, and an Oldham ring provided with a swirling key engaging, in a freely sliding manner, with said key groove formed on said swirling scroll, and a fixed key engaging, in a freely sliding manner, with said key groove formed on said housing, wherein at least one side surface of said swirling key and said fixed key has a plurality of fine grooves.

In the second invention, because the plurality of fine grooves formed on the side surface of the swirling key and the fixed key of the Oldham ring retains lubricating oil, abrasion and seizure can be reduced.

In addition, in order to solve the above problem, the scroll hydraulic machine according to the third present invention is formed from a housing having a key groove wherein a plurality of fine grooves is formed on at least one side surface, a fixed scroll disposed in said housing, a swirling scroll having a key groove wherein a plurality of fine grooves is formed on at least one side surface disposed in said housing, engaging with said fixed scroll, and moving in a swirling motion, and an Oldham ring provided with a swirling key engaging, in a freely moving manner, with the key groove formed on the swirling scroll and a fixed key engaging, in a freely sliding manner, with the key groove formed on the housing.

This third invention reduces abrasion and seizure because the plurality of fine grooves formed on at least one side surface of the key groove and the swirling key of the Oldham ring retains lubricating oil.

The first through third invention can be implemented individually, but it is desirable that they be implemented together as appropriate.

DESCRIPTION OF THE PREFERRED EMBODIMENTS

The present invention will be described below on the basis of preferred embodiments.

Figure 8:
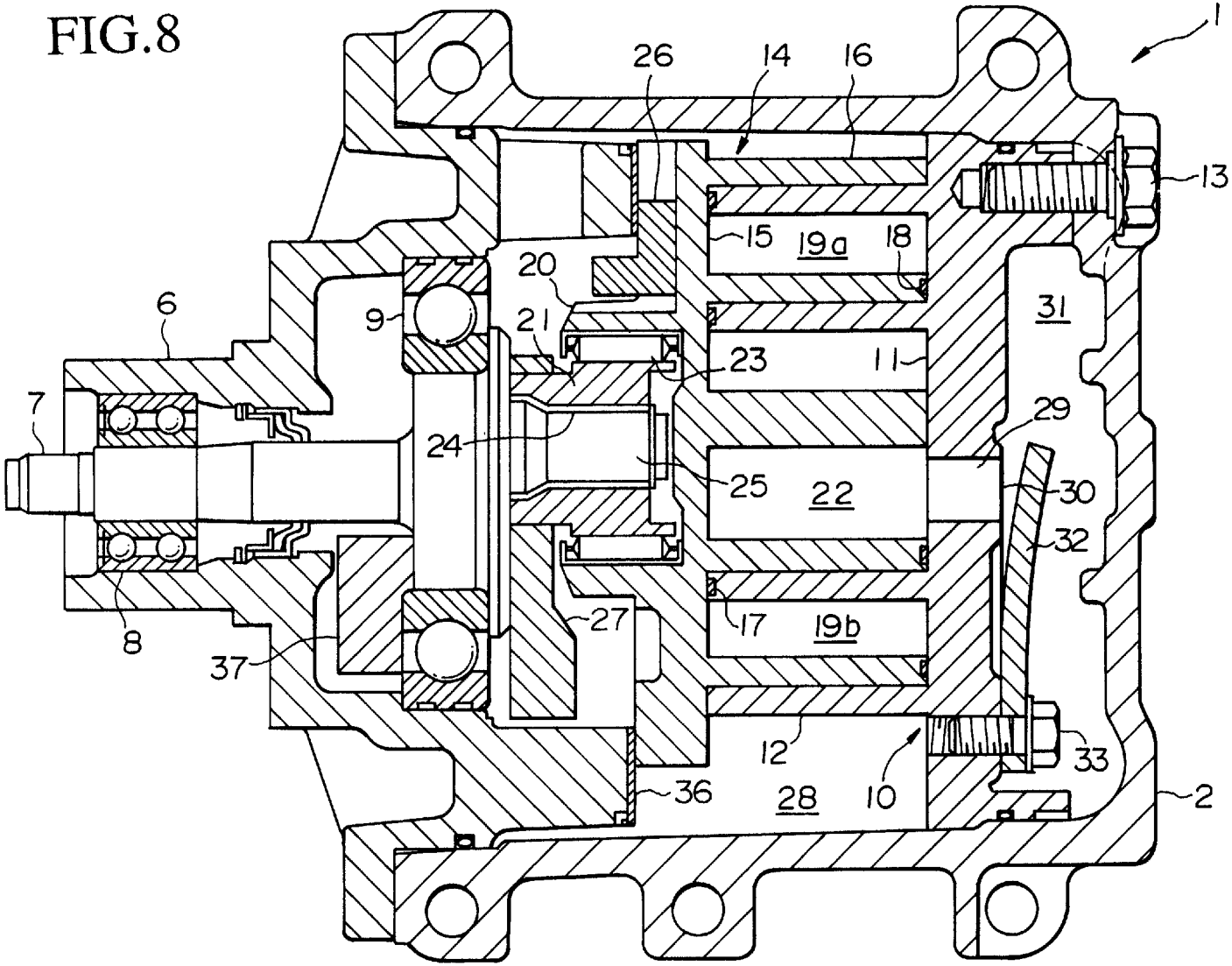
FIG. 8 is a vertical cross-sectional view showing a scroll compressor.
Figure 9:
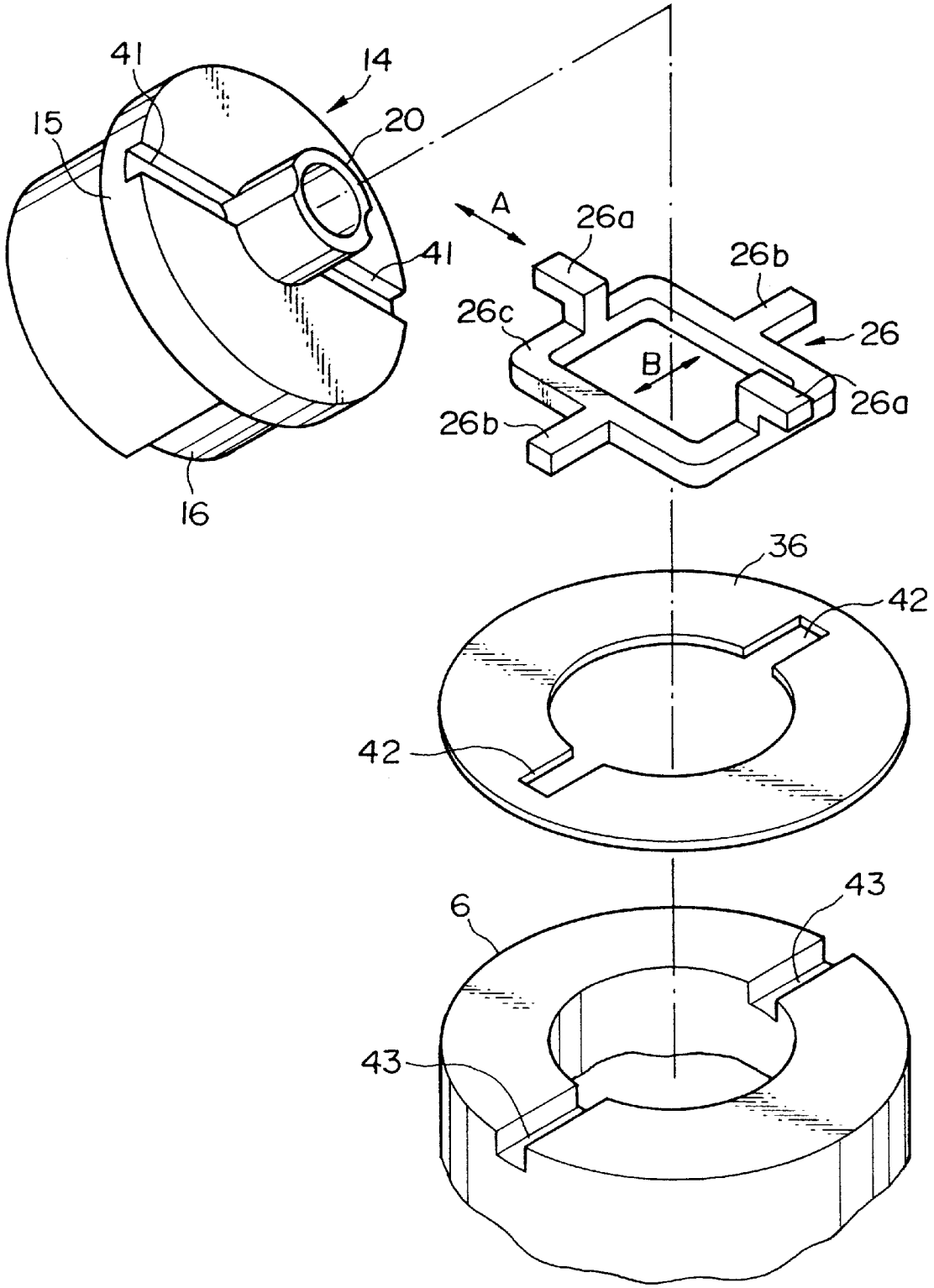
FIG.9 PRIOR ART
FIG. 9 is a partial vertical cross-sectional view showing a conventional scroll compressor.

FIG. 8 is a vertical-cross sectional view of a scroll compressor according to the present invention.

In FIG. 8, reference numeral 1 denotes a housing comprising a cup-shaped body 2 and a front housing 6 attached to the cup-shaped body 2 by a bolt (not shown). The cup-shaped body 2 and the front housing 6 are made of an aluminum alloy, corresponding, for example, to Japan Industrial Standard ADC12. A rotating shaft 7 extending through the front case 6 can freely rotate supported in the housing 1 via a bearings 8, 9.

A fixed scroll 10 and a swirling scroll 14 are disposed within the housing 1.

The fixed scroll 10 is provided with an end plate 11 and a spiral wrap 12 projecting from the inner surface thereof, and the end plate 11 is fastened to the cup-shaped body 2 by a bolt 13.

A space within the housing 1 is separated by bringing an outer peripheral surface of the end plate 11 into contact with an inner peripheral surface of the cup-shaped body 2, so that a discharge cavity 31 is formed from the outer side of the end plate 11 and a suction chamber 28 is formed from the inner side of the end plate 11.

Further, a discharge port 29 penetrates the center of the end plate 11, and the discharge port 29 is structured in such a manner as to be opened and closed by a discharge valve 30. The head of the discharge valve 30 is regulated by the valve guard 32, and one end of the discharge valve 30 and the valve guard 32 is attached to the end plate 11 by a bolt 33.

The swirling scroll 14 is provided with an end plate 15 and a spiral wrap 16 projecting from its inner surface, and the spiral wrap 16 has substantially the same shape as that of the spiral wrap 12 of the fixed scroll 10.

As shown in the figure, the swirling scroll 14 and the fixed scroll 10 are eccentrically engaged with each at a predetermined distance, and the angles thereof are eccentrically shifted only 180 degrees.

A tip seal 17 mounted on the front end surface of the spiral wrap 12 is in contact with the inner surface of the end plate 15, and a tip seal 18 mounted on the front end surface of the spiral wrap 16 is in contact with the inner surface of the end plate 11, so that the side surfaces of the spiral wrap 12 and 16 are in line contact at a plurality of points, whereby a plurality of compression chambers 19*a* and 19*b* in point symmetry with respect to the center of the spiral are formed.

A drive bush 21 that is freely rotatable is fitted to an inner portion of a cylindrical boss 20 projecting from the center of the outer surface of the end plate 15 through a swirling bearing 23, and an eccentrically shifted drive pin 25 provided in the end of the rotating shaft 7 in such a manner as to have an eccentrically shifted freely sliding center fitted within a slide groove 24 penetrating the drive bush 21.

A balance weight 27 for balancing a dynamic imbalance due to the rotating swirling motion of the swirling scroll 14 is anchored on the drive bush 21, and a balance weight 37 is anchored on the rotating shaft 7.

Between the peripheral edge of the outer surface of endplate 15 and the inner end surface of the front housing 6, a thrust bearing 36 and an Oldham ring are interposed, the thrust bearing 36 being anchored to the inner end surface of the front housing 6.

Figure 1:
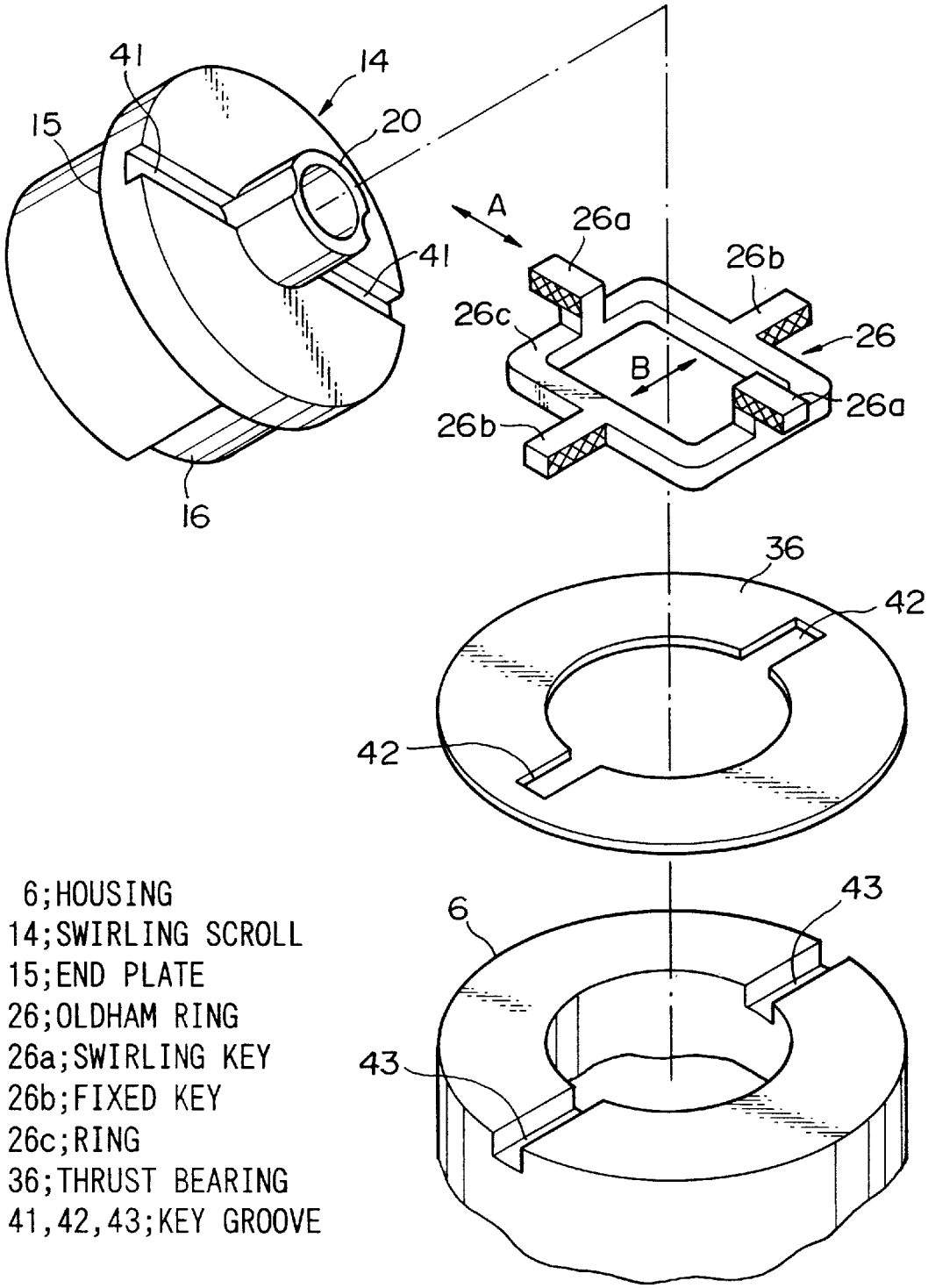
FIG. 1 is a partial perspective view which shows a scroll compressor according to the first embodiment of the present invention.

As shown in FIG. 1, the Oldham ring 26 comprises a ring 26*b*, a pair of swirling keys 26*a*, and a pair of fixed keys 26*c*. Each swirling key 26*a* is engaged so as to freely slide in the direction of arrow A on the pair of a key groove 41 bored into the outer side of the end plate 15 of the swirling scroll, and each fixed key is engaged so as to freely slide in the direction of arrow B on the key groove 42 formed on the thrust bearing 36 and the key groove 43 bored into the inner end surface of the front housing 6. Oldham ring 26 is manufactured from metallic sintered ferrous alloy including 0.2~0.8 wt % Mo in Japan Industrial Standards Z2550 SMF5.

In the first embodiment of the present invention, at least one side surface of the swirling key 26*a* and the fixed key 26*b* of the Oldham ring 26 in FIG. 1, that is, within the area indicated by the cross-hatched lines, is Sn-plated. Also, the entire surface of the Oldham ring 26 is Sn-plated.

The Sn-plating can be carried out by conventional methods, but in order to attain the object of the present invention, the plating thickness should be 3~10 $\mu$m.

When the rotating shaft 7 is rotated, the swirling scroll 14 is driven by a swirling drive mechanism comprising the eccentrically shifted drive pin 25, the slide groove 24, the drive bush 21, the swirling bearing 33, and the boss 20, and the swirling scroll 14 performs a rotational swirling motion on a circular track having a radius equal to the rotational swirling radius, while the rotation thereof is prevented by the Oldham ring 26.

Then, the line contact part between the side surfaces of the spiral wraps 12 and 16 gradually moves towards the center of the spiral, and due to this, the compression chambers 19*a* and 19*b* move towards the center of the spiral reducing the volume thereof.

At the same time, the refrigerant gas flows into the suction chamber 28 from a suction port (not shown), is introduced into the respective compression chambers 19*a* and 19*b* from an opening portion formed in the outer peripheral ends of the spiral wraps 12 and 16, is fed under compression to the center chamber 22, is discharged to the discharge cavity 31 from here through the discharge port 29 by pressing open a discharge valve 30, and then flows out through a discharge pipe (not shown).

According to the above first embodiment, the adjustment of the side surface of swirling key 26*a* that slides over the key groove 41 of the swirling scroll 14 and the fixed key 26*b* that slides over key groove 43 of the housing 6 is improved because of the Sn-plating, and because the sliding quality is improved, abrasion and seizure are prevented.

Figure 2:
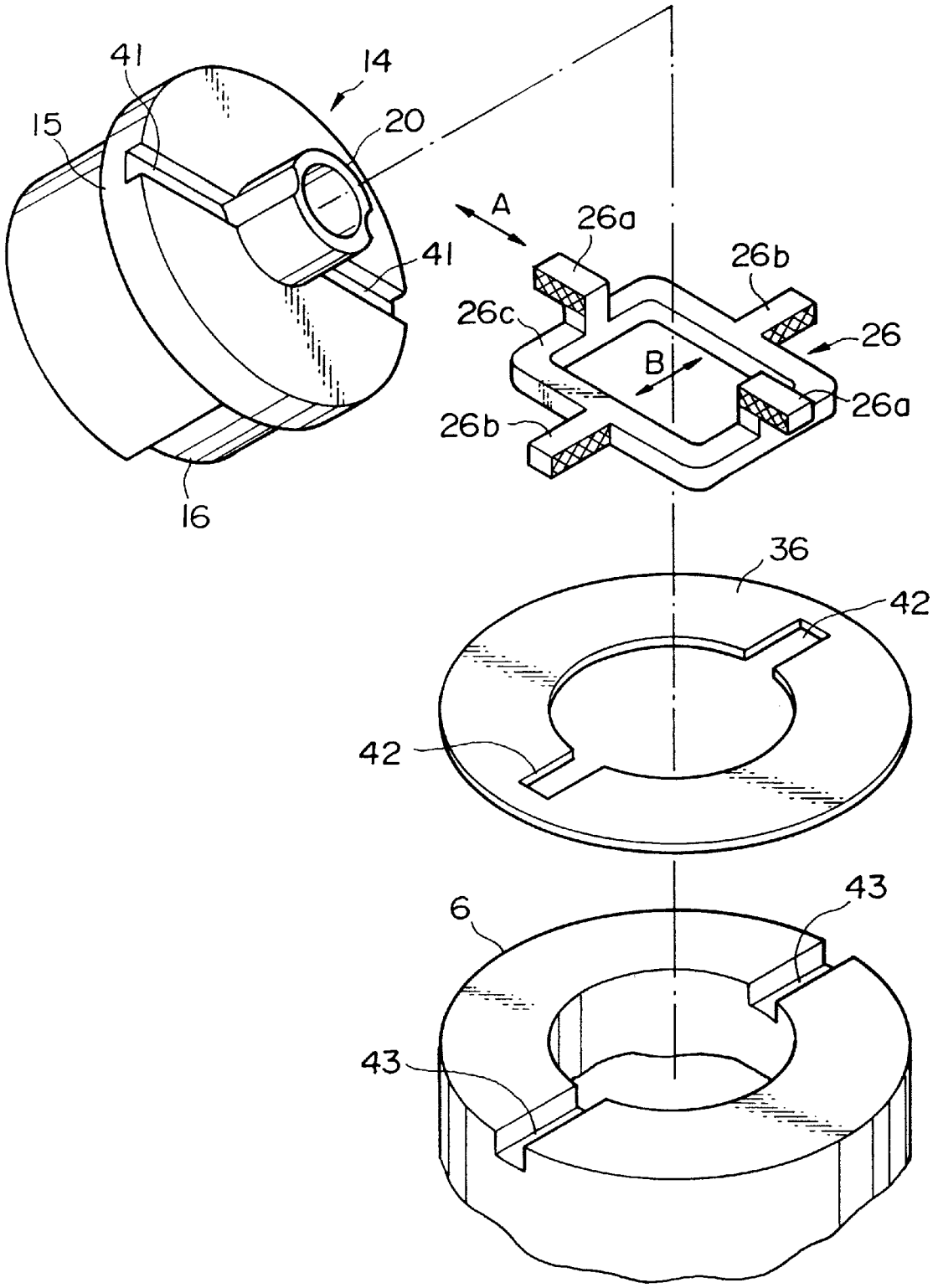
FIG. 2 is a partial perspective view which shows a scroll compressor according to the second embodiment of the present invention.

In the present invention, besides the use of Sn-plating as in the first embodiment, as shown in FIG. 2, a plurality of fine grooves can be formed on at least one side surface of the swirling key 26*a* and the fixed key 26*b* of the Oldham ring 26, that is, within the range of the area of the cross-hatching in the figure.

Figure 3:
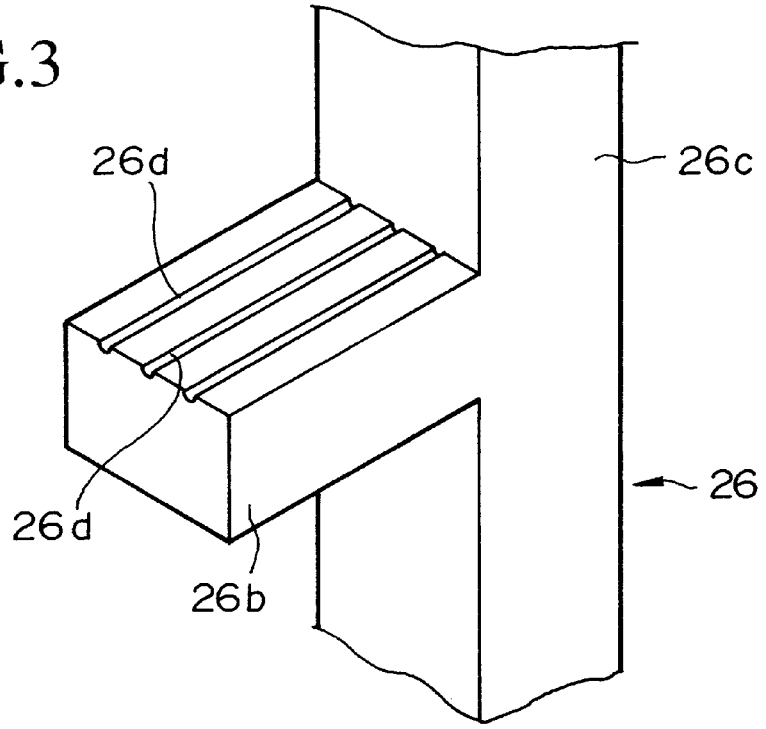
FIG. 3 is a partial perspective view which shows a groove according to the second embodiment of the present invention.
Figure 4:
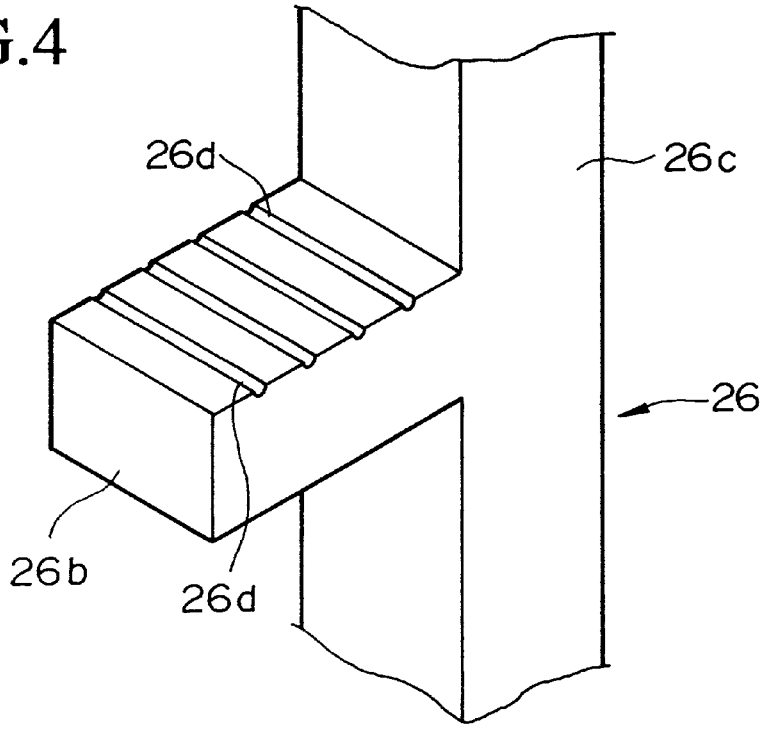
FIG. 4 is a partial perspective view which shows another groove according to the second embodiment of the present invention.
Figure 5:
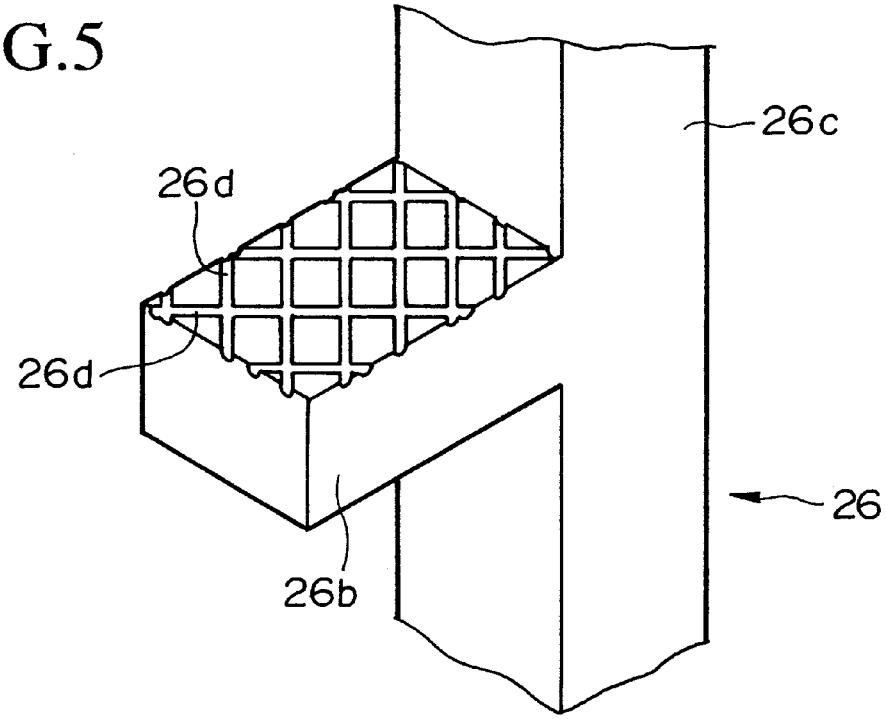
FIG. 5 is a partial perspective view which shows another groove according to the second embodiment of the present invention.
Figure 6:
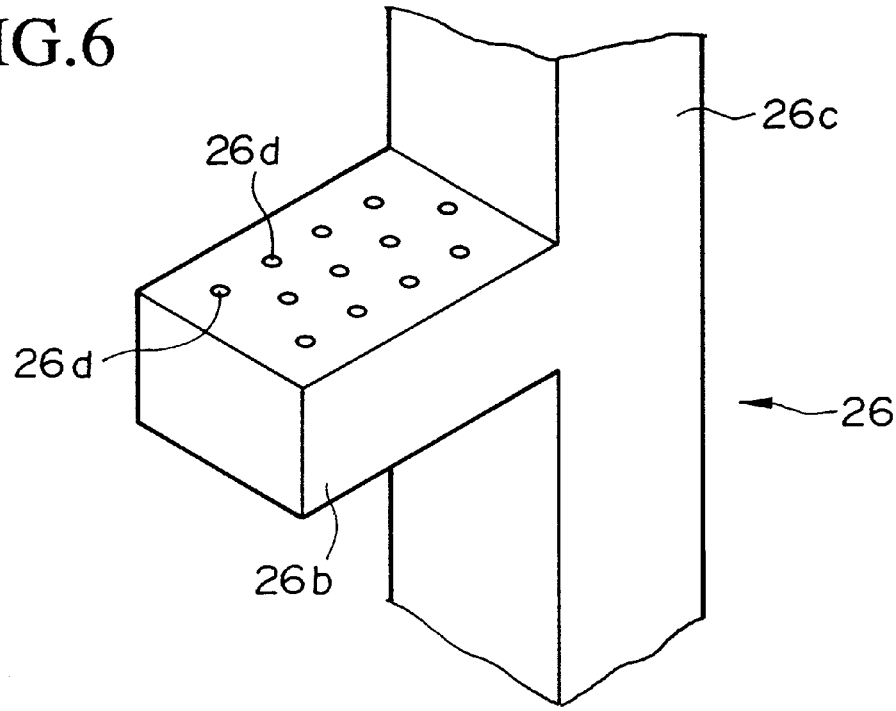
FIG. 6 is a partial perspective view which shows another groove according to the second embodiment of the present invention.

The form of these grooves can be as straight grooves formed as stripes as shown in FIG. 3 and FIG. 4, or as shown in FIG. 5, as straight grooves criss-crossing each other perpendicularly. In addition, as shown in FIG. 6, circular grooves can also be disposed in a grating. The dimensions are a width of 0~0.5 mm with a depth of 0~0.5 mm, and this is desirable from the point of view of retaining the lubricating oil. Moreover, a plurality of fine grooves can also be provided over the entire surface of the Oldham ring 26.

Thus, by proving a plurality of grooves on at least one side surface of the swirling key 26*a* and the fixed key 26*b* of the Oldham ring 26, even when the compressor is stopped for a long period of time, when it is restarted, because oil is retained in a plurality of fine grooves abrasion, seizure, and other damage to the Oldham ring 26 caused by insufficient lubrication because of the cut off of the lubricant to the sliding surfaces of the swirling key 26*a* and the fixed key 26*c*, and the key groove 41 and 43, can be avoided.

Figure 7:
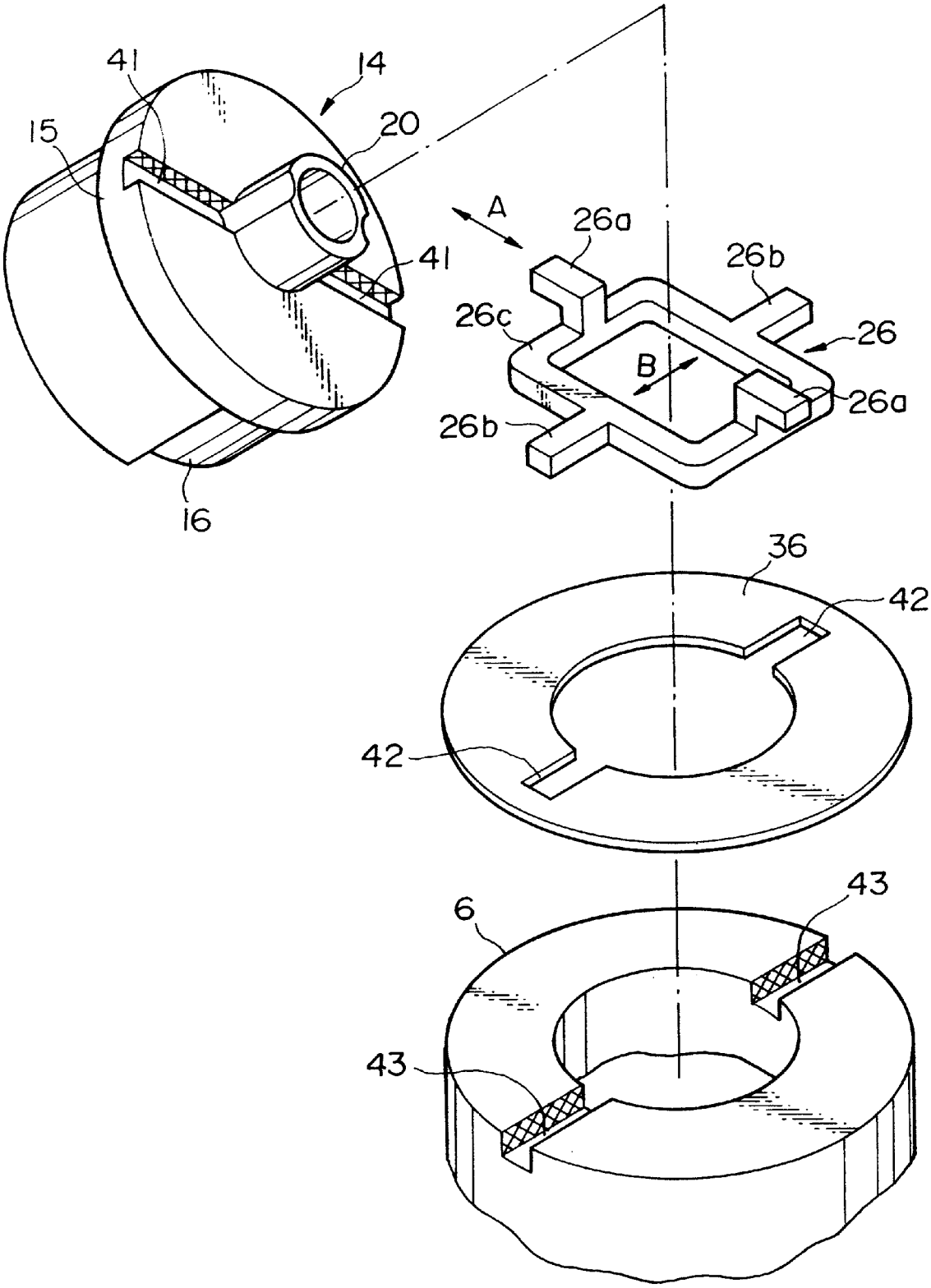
FIG. 7 is a partial vertical cross-sectional view which shows a scroll compressor according to the third embodiment of the present invention.

In addition, as shown in FIG. 7, in a third embodiment of the present invention, a plurality of fine grooves can be provided on at least one side surface of key groove 41 formed on the end plate 15 on which the swirling key 26*a* of the Oldham ring 26 slides and at least one side surface of key groove 43 formed on the front housing 6 on which the swirling key 26*b* of the Oldham ring 26 slides, that is to say, within the area of the cross-hatched lines in the figure. The forms and dimensions of the grooves can be the same as those in the second embodiment.

By providing a plurality of grooves on at least one side surface of key groove 41 formed on the end plate 15 on which the swirling key 26*a* of the Oldham ring 26 slides and at least one surface of the swirling key 26*a* and the fixed key 26*b* formed on the front housing 6 on which the fixed key 26*b* slides, even when the compressor is stopped for a long period of time, oil is retained in the plurality of fine grooves, and thus abrasion, seizure, and other damage to the Oldham ring 26 due to insufficient lubrication because of oil being cut off to the sliding surfaces of the swirling key 26*a* and the fixed key 26*b* and the key groove 41 and 43.

What is claimed is:

1. A hydraulic scroll machine comprising:

a housing having a key groove;

a fixed scroll disposed in said housing;

a swirling scroll having a key groove disposed in said housing, engaging with said fixed scroll, and moving in a swirling motion; and an Oldham ring provided with a swirling key engaging, in a freely sliding manner, with said key groove formed on said swirling scroll, and a fixed key engaging, in a freely sliding manner, with said key groove formed on said housing, and Sn plated on at least one side surface of one of said swirling key and said fixed key.

2. A hydraulic scroll machine according to claim 1, wherein a plurality of fine grooves is formed on at least one side surface of one of said swirling key and said fixed key.

3. A hydraulic scroll machine according to claim 1, wherein a plurality of fine grooves is formed on at least one side surface of one of said key groove formed on said swirling scroll and said key groove formed on said housing.

4. A hydraulic scroll machine comprising:

a housing having a key groove;

a fixed scroll disposed in said housing;

a swirling scroll having a key groove disposed in said housing, engaging with said fixed scroll, and moving in a swirling motion; and an Oldham ring provided with a swirling key engaging, in a freely sliding manner, with said key groove formed on said swirling scroll, and a fixed key engaging, in a freely sliding manner, with said key groove formed on said housing, wherein at least one side surface of one of said swirling key and said fixed key has a plurality of fine grooves.

5. A hydraulic scroll machine comprising:

a housing having a key groove wherein a plurality of fine grooves is formed on at least one side surface;

a fixed scroll disposed in said housing;

a swirling scroll having a key groove disposed in said housing, engaging with said fixed scroll, and moving in a swirling motion; and an Oldham ring provided with a swirling key engaging, in a freely moving manner, with said key groove formed on said swirling scroll and a fixed key engaging, in a freely sliding manner, with said key groove formed on said housing.

6. The hydraulic scroll machine according to claim 1, wherein said Oldham ring is formed of a ferrous alloy.

7. The hydraulic scroll machine according to claim 1, wherein said Sn is plated with a thickness of 3 to 10 $\mu$m.

* * * * *